US009228707B2

(12) United States Patent
Kraus et al.

(10) Patent No.: US 9,228,707 B2
(45) Date of Patent: Jan. 5, 2016

(54) LIGHTING SYSTEM COMPRISING AT LEAST ONE LUMINOUS BAND

(75) Inventors: Robert Kraus, Regensburg (DE); Thomas Preuschl, Sinzing (DE); Steffen Strauss, Regensburg (DE); Birgit Wels, Munich (DE)

(73) Assignee: OSRAM GmbH, Munich (DE)

( * ) Notice: Subject to any disclaimer, the term of this patent is extended or adjusted under 35 U.S.C. 154(b) by 1086 days.

(21) Appl. No.: 13/266,473

(22) PCT Filed: Apr. 29, 2010

(86) PCT No.: PCT/EP2010/055849

§ 371 (c)(1),
(2), (4) Date: Oct. 27, 2011

(87) PCT Pub. No.: WO2010/145879

PCT Pub. Date: Dec. 23, 2010

(65) Prior Publication Data

US 2012/0044689 A1 Feb. 23, 2012

(30) Foreign Application Priority Data

Apr. 30, 2009 (DE) ..... 10 2009 019 285

(51) Int. Cl.
*F21S 4/00* (2006.01)
*F21V 23/06* (2006.01)
(Continued)

(52) U.S. Cl.
CPC ..... *F21S 4/003* (2013.01); *F21V 23/06* (2013.01); *F21Y 2101/02* (2013.01); *H01R 13/717* (2013.01)

(58) Field of Classification Search
CPC ... F21V 23/00–23/06; F21V 23/003–23/0046; H01R 13/717–13/7175
USPC ..... 362/249.02
See application file for complete search history.

(56) References Cited

U.S. PATENT DOCUMENTS 4,173,035 A 10/1979 Hoyt
5,107,408 A 4/1992 Vernondier
(Continued)

FOREIGN PATENT DOCUMENTS

CN 2746249 Y 12/2005
CN 201000000 Y 1/2008
(Continued)

OTHER PUBLICATIONS

English abstract for CN 2746249Y dated Dec. 14, 2005.
(Continued)

*Primary Examiner* — Anabel Ton
(74) *Attorney, Agent, or Firm* — Viering, Jentschura & Partner; Karl Kolbinger

(57) ABSTRACT

In various embodiments, a lighting system may comprise at least one connection element and at least one luminous band having at least one band-shaped unit circuit board, whereby the unit circuit board is equipped with at least two semiconductor light sources, and has at least one contact area arranged between at least two semiconductor light sources, whereby the contact area is configured so it can be severed and the contact area and the connection element are configured such that after severing of the contact area the connection element can be applied onto the contact area and at least one circuit can be closed on the unit circuit board by applying the connection element onto the contact area.

20 Claims, 7 Drawing Sheets

(51) Int. Cl.
*H01R 13/717* (2006.01)
*F21Y 101/02* (2006.01)

(56) References Cited

U.S. PATENT DOCUMENTS

| | | | | |
|---|---|---|---|---|
| 5,559,681 | A | 9/1996 | Duarte | |
| 6,659,623 | B2 * | 12/2003 | Friend | 362/249.06 |
| 7,140,751 | B2 * | 11/2006 | Lin | 362/249.02 |
| 7,771,204 | B2 | 8/2010 | Stoyan | |
| 2003/0112627 | A1 | 6/2003 | Deese | |

FOREIGN PATENT DOCUMENTS

| | | | |
|---|---|---|---|
| CN | 201000001 | Y | 1/2008 |
| DE | 68915200 | T2 | 12/1994 |
| DE | 10051528 | A1 | 5/2002 |
| DE | 10319525 | A1 | 11/2004 |
| DE | 202005006643 | U1 | 10/2005 |
| DE | 102007003609 | A1 | 4/2008 |
| DE | 102007028463 | A1 | 1/2009 |
| DE | 102009008095 | A1 | 8/2010 |
| DE | 102009014535 | A1 | 9/2010 |
| FR | 2739524 | A1 | 4/1997 |
| GB | 2095482 | A | 9/1982 |

OTHER PUBLICATIONS

English abstract for CN 201000000Y dated Jan. 2, 2008.
English abstract for CN 201000001Y dated Jan. 2, 2008.
English abstract of DE 102009008095 A1.
English abstract of FR 2739524 A1.
English abstract of DE 10051528 A1.
English abstract of DE 102007003809 A1.
English Abstract of DE 202005006643 U1.
English Abstract of DE 10319525 A1.
English Abstract of DE 102009014535 A1.

* cited by examiner

LIGHTING SYSTEM COMPRISING AT LEAST ONE LUMINOUS BAND

RELATED APPLICATIONS

The present application is a national stage entry according to 35 U.S.C. §371 of PCT application No.: PCT/EP2010/055849 filed on Apr. 29, 2010, which claims priority from German application No.: 10 2009 019 285.9 filed on Apr. 30, 2009.

TECHNICAL FIELD

The invention relates to a lighting system including at least one luminous band and at least one connection element.

BACKGROUND

Quasi endless LED luminous bands are known which for example consist of a contiguous sequence of band-shaped unit circuit boards or unit circuit board sections and which can be divided at defined spacings between two unit circuit boards, for example every 200 mm. Such luminous bands are for example known from the LINEARLight range from the OSRAM company.

A division at spacings other than the predefined spacings between the unit circuit boards (in other words a severing of a unit circuit board) would result in an interruption of the circuit and thereby to the destruction of the LED band. For some applications however, band lengths other than the predetermined band lengths are required, for example in order to be able to run the LED band to fit exactly into a corner.

The provision between two semiconductor light sources of a contact area with bridging contacts which are designed as SMD contacts is known from DE 10 2009 008 095. If the luminous band is now to be divided at such a location, it is possible to close the circuit of the luminous band between the bridging contacts by means of soldered-in SMD resistors. By reason of the shortening of the luminous band and the resulting reduced number of semiconductor light sources, these resistors are to be designed such that the excess voltage decreases at the rated current.

For many users of such luminous bands the manual soldering of SMD resistors is difficult to handle. Furthermore, the resistance values of these termination resistors are dependent on the current of the circuit. This can result in confusion or errors in the choice of suitable resistors.

SUMMARY

Various embodiments create a lighting system which offers a way of packaging luminous bands which is simple to implement, in particular with regard to a division within a unit circuit board.

The lighting system includes at least one connection element, in particular a plug and/or clamping connection element, and at least one luminous band having at least one band-shaped unit circuit board, whereby the unit circuit board is equipped with at least two semiconductor light sources, in particular light emitting diodes (LED), and has at least one contact area arranged between at least two semiconductor light sources, whereby the contact area is formed so it can be severed and the contact area and the connection element are designed such that after severing of the contact area the connection element can be applied onto the contact area and at least one circuit can be closed on the unit circuit board by applying the connection element onto the contact area.

Within the scope of this application, connection elements are considered to be all the devices for making electrical contact for a circuit board which are suitable for establishing by a mechanical means, in other words essentially avoiding heat and/or chemical processes, an electrical connection which, depending on the embodiment, can also be released again.

The luminous band can be divided in the contact area by using simple means, for example by cutting, scoring, breaking or similar, and thereby be provided at the required length. The now open circuit is subsequently closed on the circuit board by applying the connection element to the division point, pushed on for example in the case of a plug connection element, which can be achieved considerably more simply than by performing an SMD soldering operation for example. Moreover, thermal stress caused by the soldering process is avoided. The choice of the appropriate component for closing the circuit, the correct resistor for example, can be likewise simplified through the design of the connection element because the latter can be designed in such a manner that any mistakes are avoided.

By providing at least one electronic component, in particular at least one resistor and/or at least one diode, for closing the at least one circuit, this ensures that the circuit is adequately protected, in other words such that any overloading of component parts, in particular of the semiconductor light sources and/or of the power supply, is excluded and the required performance is achieved.

Advantageously, the arrangement of the contacts in the contact area is designed dependent on the number of semiconductor light sources between a current infeed point and/or an end point of the luminous band and the contact area. The position of the contacts is thereby correlated with the number of severed or remaining semiconductor light sources, which can thereby also be simply recognized and thereby enables the choice of an appropriate component for closing the circuit or of an appropriate connection element.

By means of a connection element having an arrangement of countercontacts, which are operationally connected to appropriate elements for closing at least one circuit, matching the arrangement of the contacts on the luminous band it is possible to ensure that the circuit is adequately protected, in other words such that any overloading of component parts, in particular of the semiconductor light sources and/or of the power supply, is excluded and the required performance is achieved. In addition, through the choice of an appropriate connection element it is where applicable possible to make a choice as to which circuit of the luminous band is closed, and thus for example to make a choice of a lighting function.

It is furthermore advantageous if, depending on the number of semiconductor light sources, different circuits are capable of being closed between a current infeed point and/or an end point of the luminous band and a contact area. By this means it is likewise possible to ensure that the circuit is adequately protected, in other words such that any overloading of component parts, in particular of the semiconductor light sources and/or of the power supply, is excluded and the required performance is achieved.

Advantageously, at least one contact, which is provided for transmitting a potential which is approximately the same at a plurality of contact areas, in particular at all contact areas, has the same position in the transverse direction at these contact areas. This enables a simple design of the connection element which can be applied to the severed contact area because the countercontact for this potential can always be arranged at the same location of the connection element.

Advantageously, as the number of semiconductor light sources between a current infeed point and/or an end point of the luminous band and the contact area increases, further contacts of the same contact area are distanced further from the at least one contact which is provided for transmitting a potential which is approximately the same at a plurality of contact areas, in particular at all contact areas.

By this means it is possible to establish a particularly simple connection of the contacts in the connection element, whereby the crossing of connection lines is avoided.

In an advantageous embodiment of the invention, at least one electronic component provided for closing the at least one circuit is arranged in the area of the connection element, in particular inside a housing at least partially enclosing the connection element. By this means, a particularly simple construction having just a few component parts is achieved which can be assembled with little effort. If the luminous band is arranged on an appropriate substrate for the dissipation of heat, for example a heat sink, the connection element can likewise be operationally connected thereto in a simple manner and the heat from the electronic components can thus be dissipated in a simple manner.

In a further advantageous embodiment of the invention, at least one electronic component provided for closing the at least one circuit is arranged spatially separate from the connection element. This means that connection element can be implemented in a particularly compact form, which can be advantageous for example for fitting the luminous band in spatially restricted conditions. In this situation, the electronic components can be arranged at a suitable mounting location, even at some distance from the luminous band.

Expediently, at least one electronic component provided for closing the at least one circuit is arranged on a cooling device, in particular a heat sink. The electronic components can, in particular when a large number of LEDs are separated from the unit circuit board and a large amount of power thereby flows into the electronic components, develop considerable heat which can thus be dissipated in a simple manner.

It is advantageous if the connection element includes at least one zero insertion force connection element, in particular is designed as a zero insertion force connection element. By this means, the connection element can be applied onto the luminous band simply and with a low risk of damage.

It is furthermore advantageous if at least two current-carrying elements, in particular contacts and/or conductor paths, which can be subjected to a different potential during operation of the luminous band, arranged in at least one contact area on opposite sides of the luminous band, are arranged transversally spaced from one another in the contact area. In the case of typical luminous bands the flexible circuit board, which carries conductor paths and/or contacts in each case on the upper side and the lower side, is designed to be as thin as possible. The inventive design serves to prevent any contact being accidentally established between the current-carrying components situated on the upper side and the lower side when cutting takes place.

The features described for the lighting system according to the invention can also be implemented individually in each case in the component parts forming the system, in other words a luminous band and suitable connection elements, which can also be marketed individually.

BRIEF DESCRIPTION OF THE DRAWINGS

In the drawings, like reference characters generally refer to the same parts throughout different views. The drawings are not necessarily to scale, emphasis instead being generally upon illustrating the principles of the invention. In the following description, various embodiments are described with reference to the following drawings, in which.

DETAILED DESCRIPTION

The following detailed description refers to the accompanying drawings that show, by way of illustration, specific details and embodiments in which the invention may be practiced.

Figure 1:
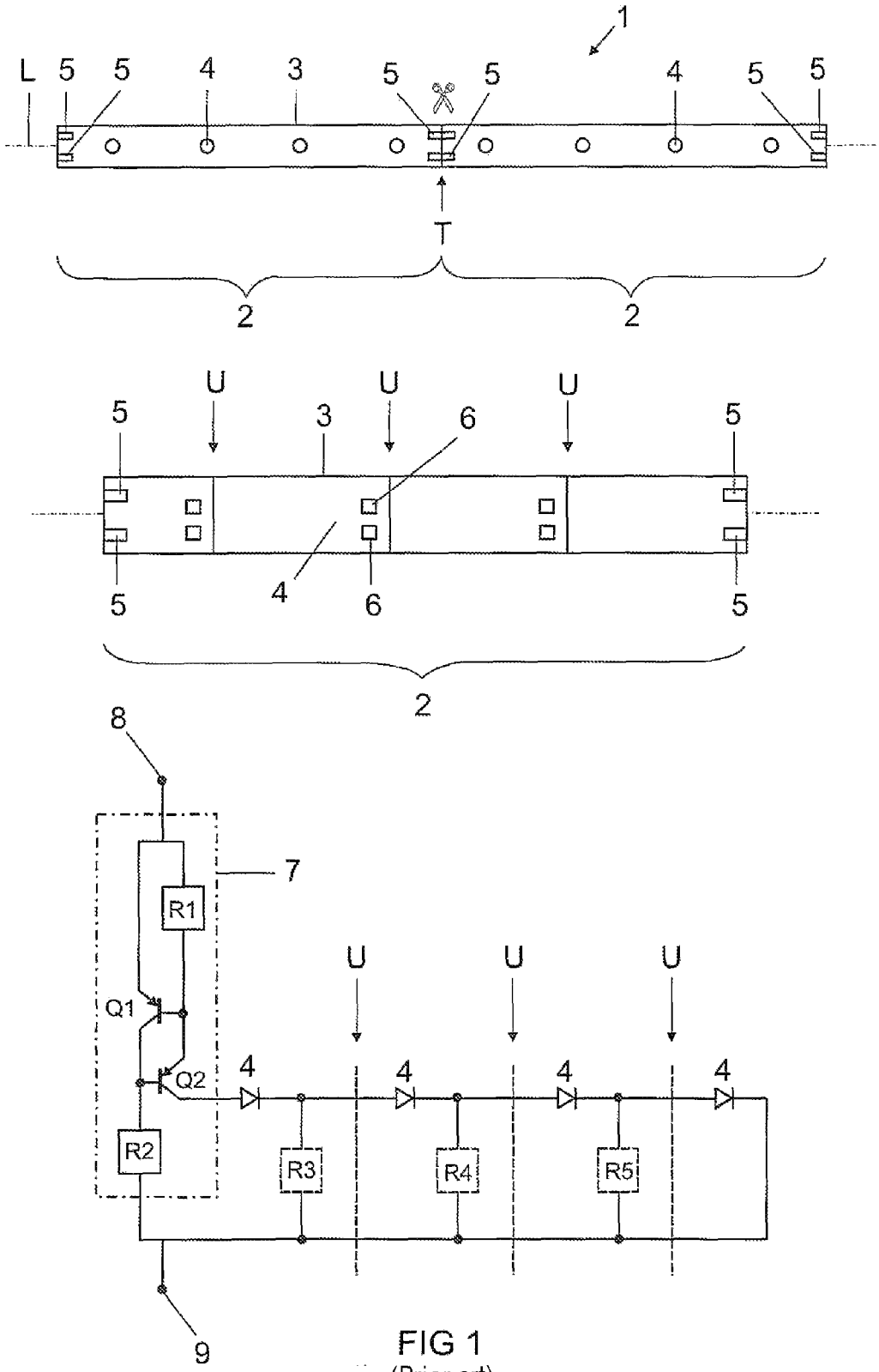
FIG 1 (Prior art)
FIG. 1 shows a luminous band in accordance with the prior art.

FIG. 1 (top) shows a top view of a conventional flexible luminous band 1 consisting by way of example of two contiguous identical unit circuit boards 2. Each of the unit circuit boards 2 has a flexible substrate 3 made of polyimide, the front side of which visible here is equipped with four light emitting diodes 4. The light emitting diodes 4 are positioned evenly spaced (equidistantly) with respect to a longitudinal direction of the unit circuit board 2. At both (viewed with respect to the longitudinal direction) end regions, each of the unit circuit boards 2 has electrical contacts 5, here: two contacts 5 in each case.

With regard to the manufacture of the luminous band 1 the unit circuit boards 2 are manufactured integrally, whereby the substrates 3 of the unit circuit boards 2 are present as a single, one-piece quasi-continuous substrate of the luminous band 1. Likewise, the contacts 5 abutting against one another of two adjacent unit circuit boards 2 are implemented as a single contact strip which extends over both unit circuit boards 2.

In order to divide the luminous band 1 this can, as indicated symbolically by the scissors, be divided along a dividing line T. In order that a division of the luminous band 1 does not result in an interruption of current to all the unit circuit boards 2, the unit circuit boards 2 are interconnected electrically in parallel. When a division is made, only those unit circuit boards 2 which are severed from an—for example external—electrical source of supply are therefore cut off from a current supply. However, a division between light emitting diodes 4 of a unit circuit board 2 has the consequence that all the light emitting diodes 4 of this unit circuit board 2 fail because the light emitting diodes 4 of one unit circuit board 2 are connected electrically in series.

FIG. 1 (center) shows a top view of a unit circuit board 2 in a detail view in accordance with the prior art. Between each two light emitting diodes 4 is arranged a pair of bridging contacts 6 in the form of soldering fields. Each of the pairs of bridging contacts 6 can for example be bridged by soldering-on a surface-mountable resistor (not illustrated). As a result of this arrangement, the unit circuit board 2 can be severed between two light emitting diodes 4, for example along a dividing line U, more precisely between a pair of bridging contacts 6 and the light emitting diode 4 connected electrically downstream, here: arranged further to the right.

FIG. 1 (bottom) shows a possible circuit diagram for the unit circuit board 2. At one end, here the left-hand end, the unit circuit board 2 is equipped with a control circuit 7 which has two transistors Q1, Q2 and two resistors R1, R2. The control circuit 7 is connected by way of the contacts 8 and/or 9 to an electrical supply (not illustrated). The light emitting diodes 4 are connected electrically in series downstream of the control circuit 7. If the unit circuit board 2 is severed along the dividing lines U from FIG. 1 (top) without additional measures being taken, the circuit of this unit circuit board 2 will be interrupted, which means that none of the light emitting diodes 4 would be illuminated any longer. As a result of an electrical bridging of a pair of bridging contacts 6 by means of a respective bridging resistor R3, R4 or R5, the circuit can be closed again upstream (with respect to the control circuit 7) of the bridging contacts 7, which means that the light emitting diodes 4 present in the section of the circuit which is then closed again can be illuminated. Since power is also to be dissipated by way of the bridging resistors R3, R4, R5, an advantageous package size of at least 0603 (imperial, 1608 in metric), 0805 (imperial, 2012 in metric) or in particular 1206 (imperial, 3216 in metric) is preferred for SMD resistors. In the event of an essentially resistance-free bridging, too low a voltage drop would occur by way of the light emitting diodes 4 still supplied with current.

Figure 2:
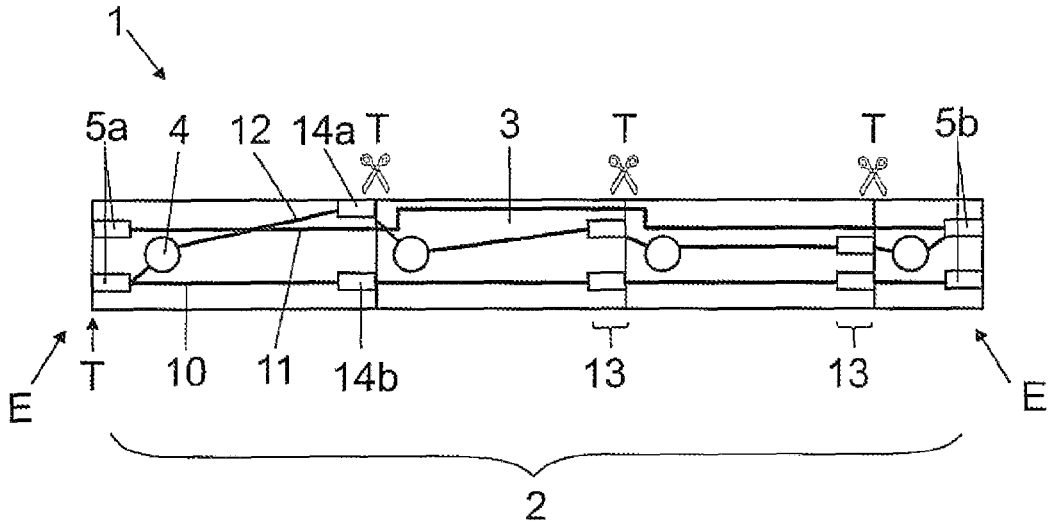
FIG. 2 shows a luminous band for a lighting system according to the invention.

FIG. 2 shows a schematic top view of a unit circuit board 2 of a luminous band 1 for a lighting system according to the invention. The layout of the unit circuit board 2 is likewise shown schematically. The basic structure corresponds to the luminous band 2 shown in FIG. 1, in other words each of the unit circuit boards 2 has electrical contacts 5*a*, 5*b*, here two contacts 5*a*, 5*b* in each case, at both (viewed with respect to the longitudinal direction) end areas E.

In order to divide the luminous band 1 this can, as indicated symbolically by the scissors, be divided along a dividing line T.

The layout of the unit circuit board 2 essentially corresponds to the circuit diagram shown in FIG. 1 (bottom), whereby the control circuit 7 has not been included in the illustration. Two continuous conductor paths 10, 11 are provided which can also be used for the power supply to downstream unit circuit boards 2, such that the unit circuit boards 2 of a luminous band 1 are connected electrically in parallel. Within a unit circuit board 2, the LEDs 4 are connected in series by means of a conductor path 12 connecting the LEDs 4.

At the dividing lines T, in each case a contact area 13 is provided at which a first continuous conductor path 10 and also the conductor path 12 connecting the LEDs 4 are in each case provided with a contact 14*a*, 14*b*. If the unit circuit board 2 is severed along one of the dividing lines T without additional measures being taken, the circuit through the light emitting diodes 4 will be interrupted. As a result of an electrical bridging of a pair of contacts 14*a*, 14*b* by means of a respective bridging element, the circuit can be closed again, which means that the light emitting diodes 4 present in the section of the circuit which is then closed again can be illuminated. To this end, a matched resistor is for example required which dissipates the necessary power, depending on the number of LEDs 4 operated or severed.

The contacts 14*b* of the continuous conductor path 10 (which naturally have approximately the same potential at all contact areas 13) are situated at the same position at all contact areas 13 viewed in the transverse direction of the luminous band 1, whereas the position of the contact 14*a* of the conductor path 12 connecting the LEDs 4 varies depending on the number of LEDs 4 between the dividing point T and the contacts 5*a* for feeding current into the unit circuit board 2. In the present exemplary embodiment, as the number of operated LEDs 4 increases, the distance between the contact 14*b* of the continuous conductor path 10 and the contact 14*a* of the conductor path 12 connecting the LEDs decreases, in other words as the number of severed LEDs 4 increases, the distance between the contact 14*b* of the continuous conductor path 10 and the contact 14*a* of the conductor path 12 connecting the LEDs 4 increases.

Figure 3:
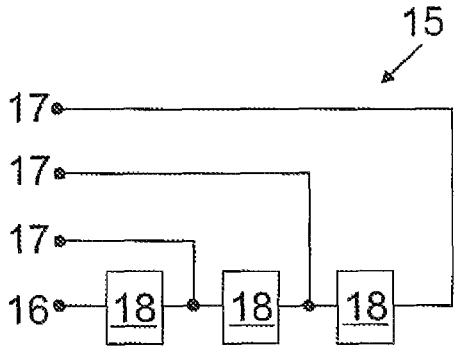
FIG. 3 shows a wiring diagram of a connection element according to the invention.

This enables a particularly simple construction of the connection element 15, the circuit diagram for which is shown by way of example in FIG. 3. One contact 16 of the connection element 15 is provided for making contact with the contact 14*b* of the continuous conductor path 10, while the contacts 17 are provided for making contact with the contacts 14*a* of the conductor paths 12 connecting the LEDs 4. The elements 18 represent electronic components 18*a* which are required for closing a circuit of the luminous band 1. One element 18 is provided in each case to compensate for the absence of an LED 4, in other words the voltage drops at the element 18 to the same extent as at an LED 4 used on the luminous band 1. If the distance between the contacts 14*a* and 14*b* decreases as the number of severed LEDs 4 increases (or increases as the number of operated LEDs 4 decreases), the connection element 15 can thus be configured without crossing conductor paths, which simplifies the manufacturing process.

The elements 18 can for example consist of individual resistors or diodes or also of arrays of such electronic components 18*a*. The use of resistors offers a simple and cost-effective variant if the luminous band is operated at a constant current in all application situations because the voltage drop at the resistor is then also clearly defined. If the connection element 15 is to be capable of being operated at different currents, the more elaborate use of diodes is advisable because these always exhibit the same voltage drop as would also occur at the severed LEDs 4.

FIG. 4 shows different embodiments of a connection element according to the invention. A connection element 15 is shown in FIG. 4 a which is essentially constructed from a so-called ZIF connector 19, in other words a zero insertion force connection element 19, with an FR4 board 20, in other words a board constructed from epoxy resin and glass fiber fabric, connected directly and fixedly thereto. The connection element 15 can be used in order to replace up to three severed LEDs 4 which are substituted by three diodes 21 as electronic components 18*a*. The construction corresponds to the diagram shown in FIG. 3. FIG. 4*b* shows a connection element 15 identical to a large extent to that shown in FIG. 4*a*, whereby an additional (concealed in the ZIF connector 19) contact is now provided here for connecting to the second continuous conductor path 11 of the luminous band. The two continuous conductor paths 10, 11 can thereby be extended beyond the connection element 15 by means of the connection cables 22 in order for example to be connected to further luminous bands 2.

Figure 4A:
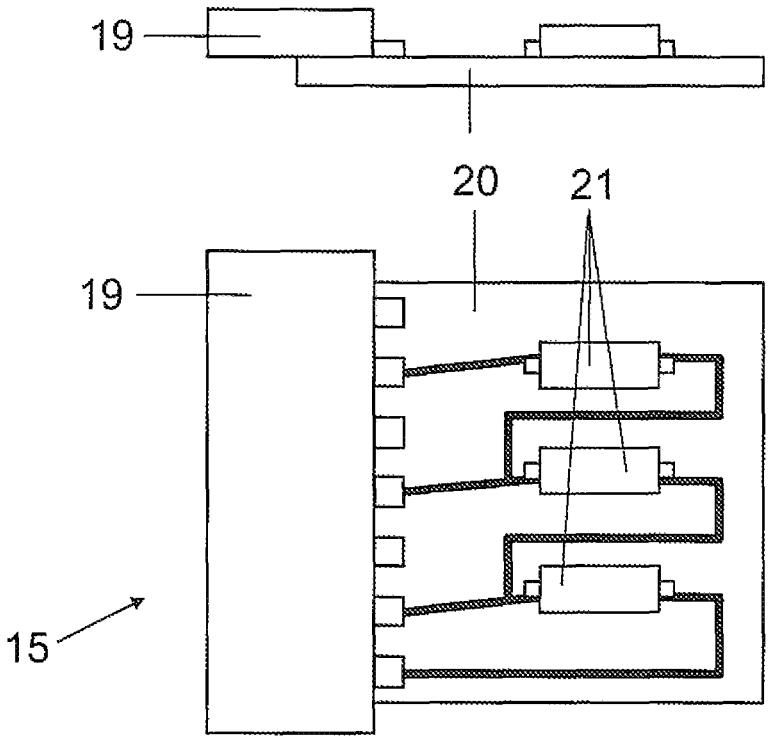
FIG. 4 shows a plug element as an example of a connection element according to the invention.
Figure 4B:
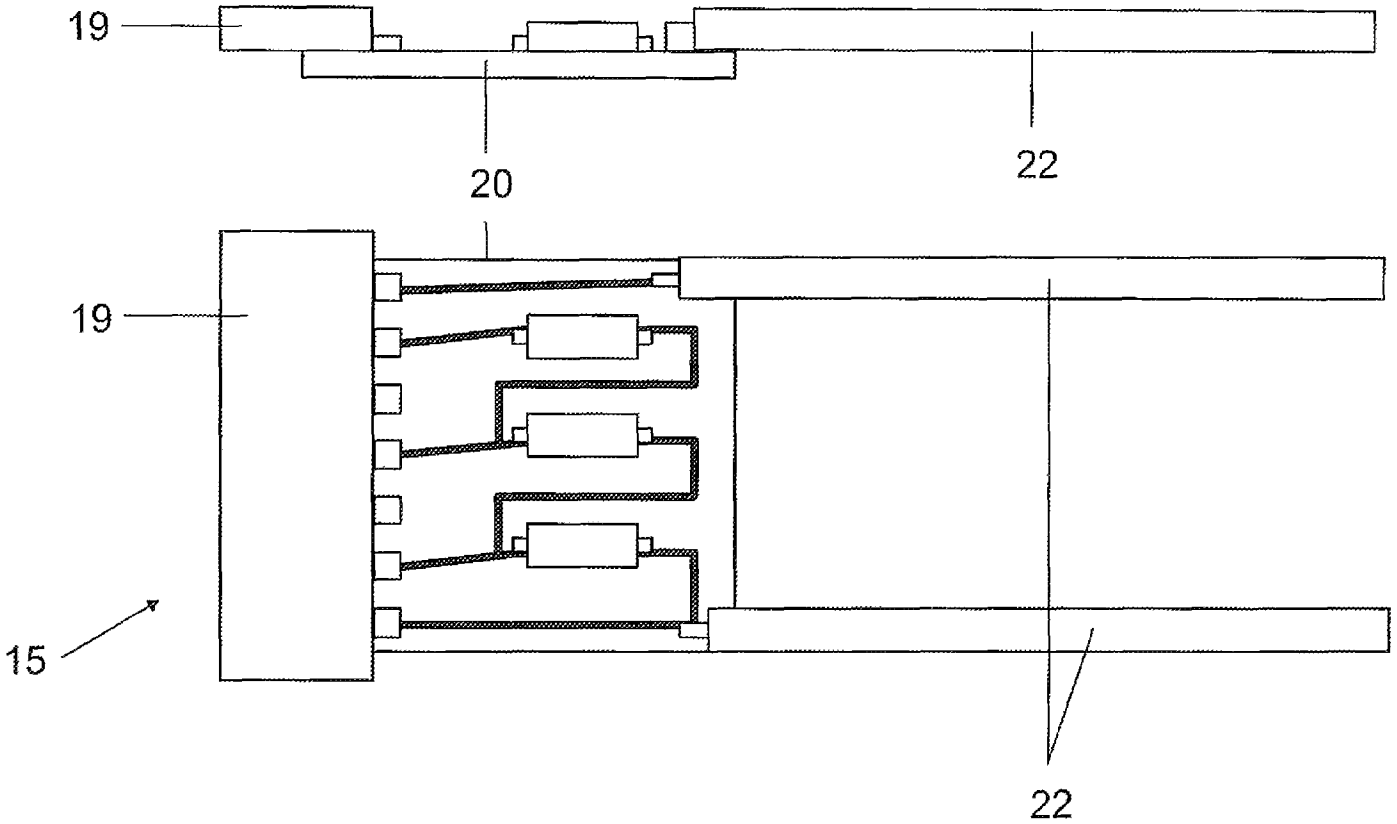
Figure 4C:
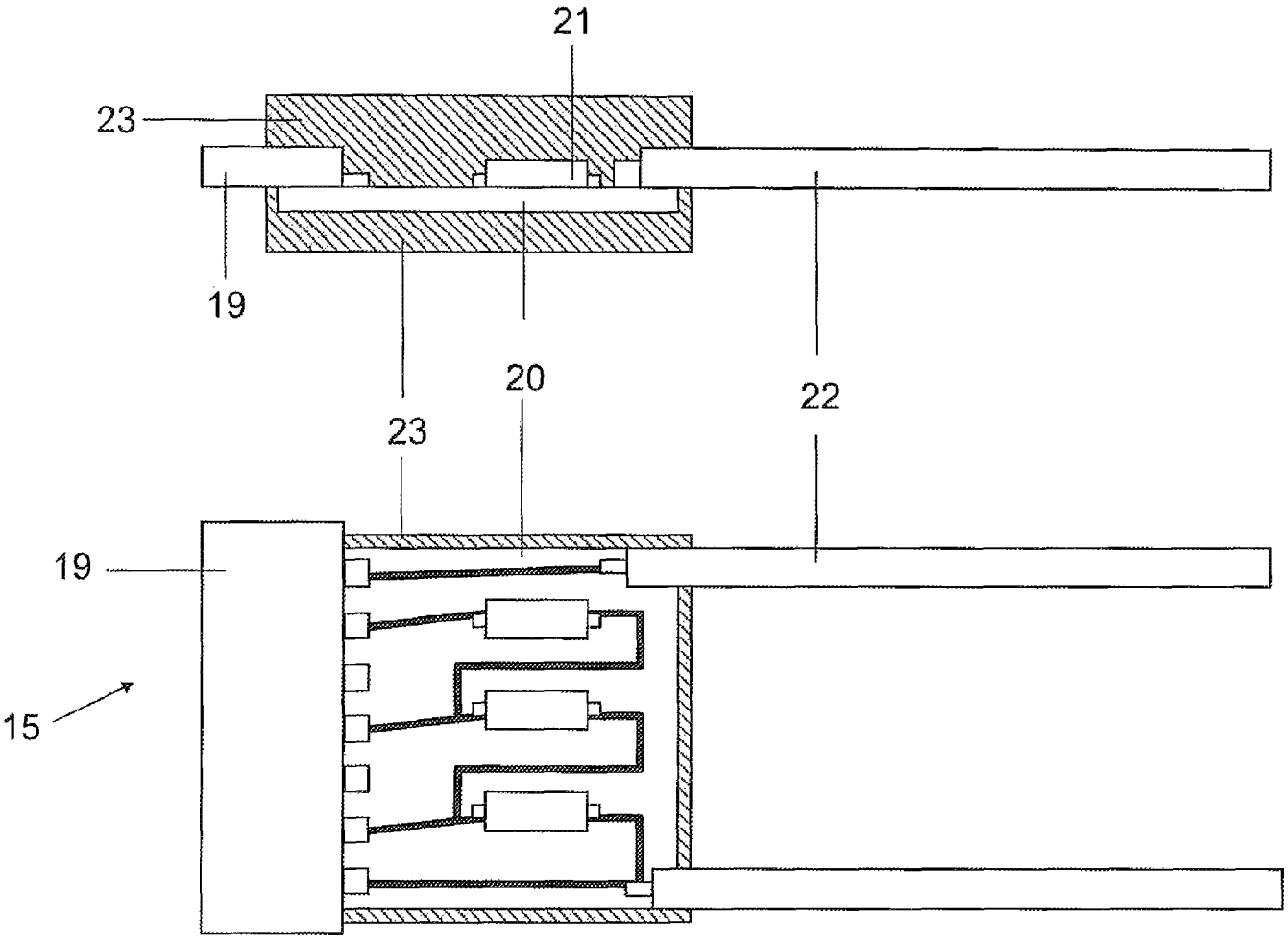
Figure 4D:
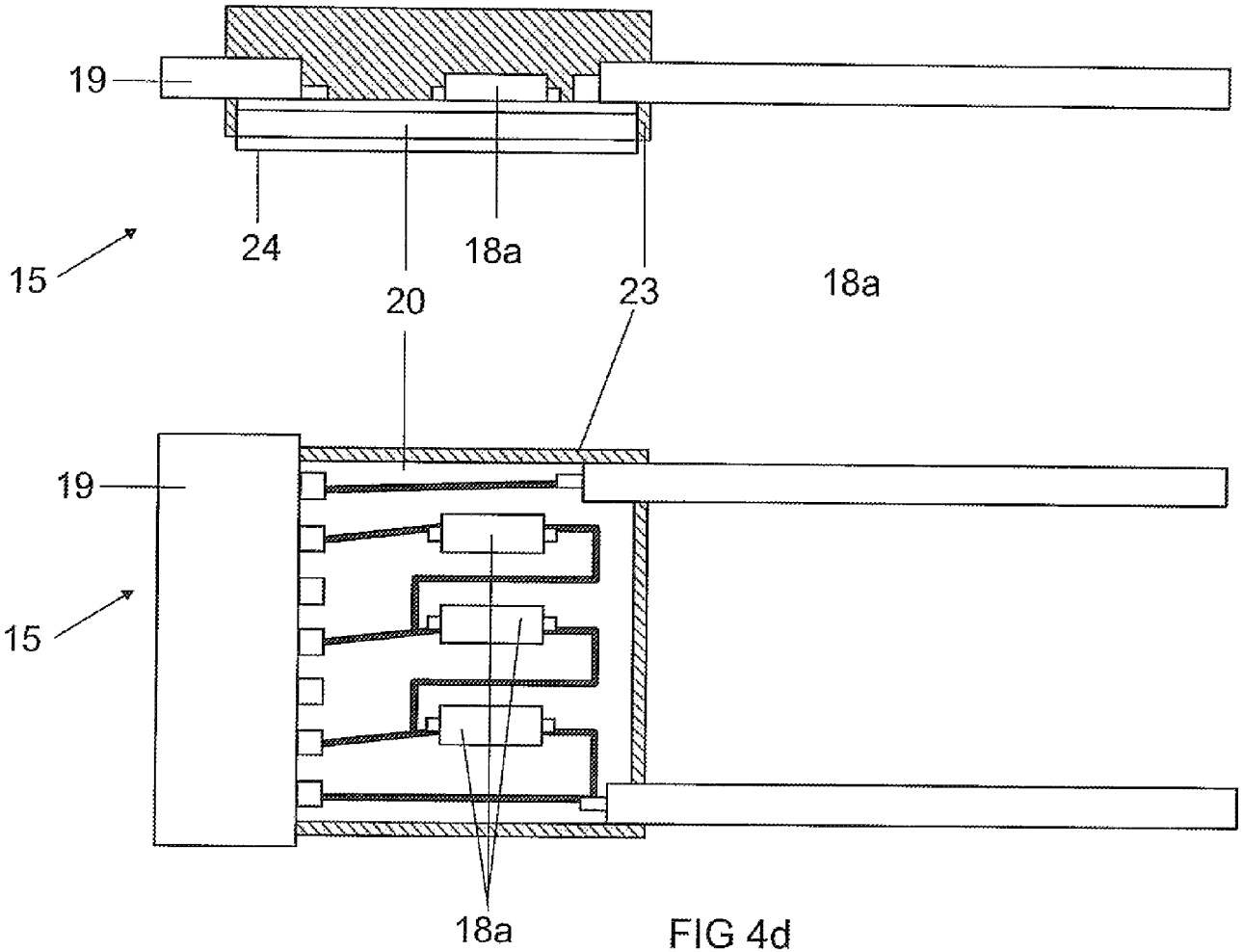

FIG. 4*c* shows a variant of the connection element 15 shown in FIG. 4*b*, wherein a housing 23 encloses the board 20, the diodes 21 and also in part the ZIF connector 19 and also the connection cables 22. In the present exemplary embodiment, the housing 23 is implemented as an injection molded part which for the purpose of improved heat dissipation is filled with so-called seal gel, in other words a mass which is heat dissipating, electrically insulating and where necessary offers protection against moisture. Other embodiments of the housing 23 are conceivable, both in respect of the design and the manufacture and also of the material used, for example in the form of an encapsulation or through application of a hot melt adhesive.

FIG. 4 *d* shows a further exemplary embodiment of a connection element 15 according to the invention. As distinguished from the example shown in FIG. 4*c*, here the board 20 is implemented as a metal core printed circuit board which enables a better heat dissipation from the electronic components 18*a*. In order to further improve the heat dissipation, the board 20 is not enclosed by the housing 23 on its underside and can thus be connected directly by means of an adhesive layer 24 to a heat sink (not illustrated here) which for example is also used for cooling the luminous band 1.

Figure 5:
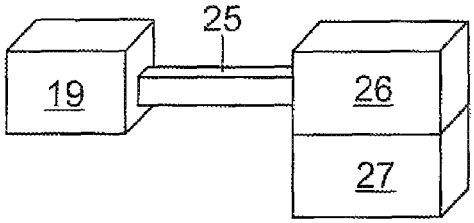
FIG. 5 shows a further plug element as an example of a connection element according to the invention.

A further embodiment of the connection element is shown schematically in FIG. 5. Here, a connector 19 is connected as a connection element 15 by means of a cable connection 25 to an electronics module 26 which contains the elements 18 required for closing the circuit and is in turn arranged on a heat sink 27. This type of construction is particularly well suited if high power levels need to be dissipated since as a result of the spatial separation of the electronics module 26 from the luminous band 1 the thermal load on the latter can be considerably reduced. Moreover, the connector 19 at the end of the luminous band 1 requires substantially less installation space than if an arrangement according to FIG. 4 is installed.

Figure 6:
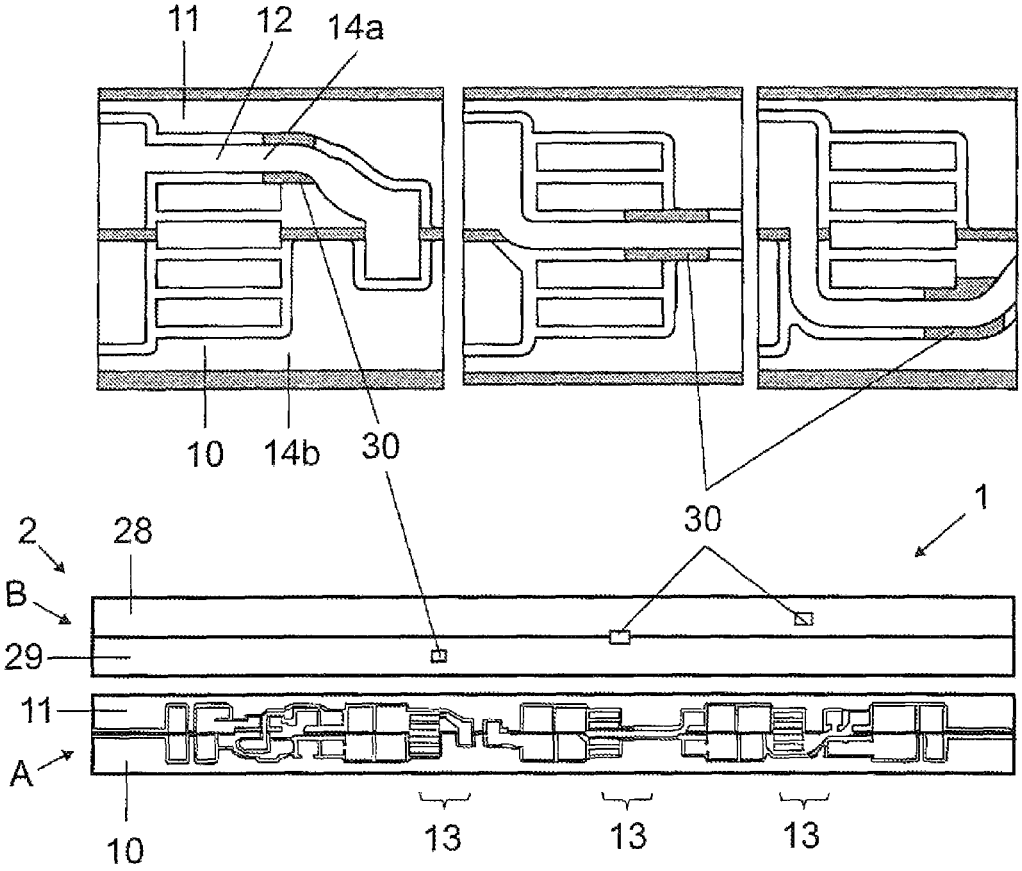
FIG. 6 shows an illustration of a luminous band according to the invention.

FIG. 6 shows an exemplary embodiment of an inventive luminous band 1, not yet equipped with components, in an overall view (bottom) and also in three detail views (top). On the rear side B of the luminous band 1, in other words on the side facing away from the LEDs 4, two continuous conductor paths 28, 29 are provided which can also be used for supplying power to downstream unit circuit boards 2. On the front side A are arranged further conductor paths 10, 11, 12 which are provided primarily for supplying voltage to the LEDs. At the side in this situation are provided the continuous conductor paths 10, 11 which can also be used for supplying power supply to downstream unit circuit boards. After they have been severed, contact can also be made with these conductor paths 10, 11 by means of a pushed-on ZIF connector 19 while commercially available ZIF connectors offer no capability for making contact with the conductor paths 28, 29 on the underside B. In each of the detail views a contact area 13 is shown which has contacts 14*a* of the conductor path 12 connecting the LEDs 4 and also contacts 14*b* of the conductor path 10. With regard to luminous bands according to the prior art, in particular those where a relatively thin carrier material and relatively thick conductor paths are used, as in the present exemplary embodiment in which a polyimide film 25 μm thick is arranged between copper conductor paths 50 μm thick, it can happen when severing a dividing point T that the two copper layers come into contact with one another, which means that a short-circuit may result in the event of a difference in potential. In order to avoid this situation, in the exemplary embodiment shown the lower conductor paths 28, 29 are provided with recesses 30 in the contact area 13, such that they are spaced away there transversally from the contacts 14*a* situated above which may have a different potential. Such a principle can be applied in the case of all luminous bands which are capable of being severed, irrespective of whether a connection element 15 or a soldered connection is used or even if no further processing whatsoever takes place.

Further embodiments of the invention are naturally also conceivable; in particular, the person skilled in the art will without difficulty be able to determine a combination of the features shown in the exemplary embodiments appropriate to the practical requirements. For example, it is conceivable for the electronic components 18*a* to be integrated directly in a connector 19. The layout of the luminous bands 1 as well as of the connection elements 15 can also be adapted by simple means to suit special circumstances of the applications. In particular, it is conceivable to use identical connection elements 15 with different types of luminous bands 1, or else in the case of identical luminous bands 1 to use different connection elements 15 which for example are specifically designed for the intended use on the basis of their geometry, the components 18*a* used or other features. The different embodiments in FIG. 4, each of which can be used with identical luminous bands 1, can also serve as examples in this situation.

The severing of the luminous band 1 can be effected for example by cutting, or by scoring and breaking. The circuit board 2 can, among other things, advantageously be flexible ('flexband') in order to also apply the luminous band 1 onto curved surfaces.

Instead of or in addition to LEDs 4, laser diodes can also be used as the semiconductor light source. Instead of a ZIF connector 19, establishing contact for the luminous band 1 can also be effected by means of other suitable connection elements, in particular by means of a different connector or a clamping connection.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lighting system comprising at least one connection element and at least one luminous band having at least one band-shaped unit circuit board, whereby the unit circuit board is equipped with at least two semiconductor light sources and has at least one contact area arranged between at least two semiconductor light sources, whereby the contact area is formed so it can be severed and the contact area and the connection element are configured such that after severing of the contact area the connection element can be applied onto the contact area and at least one circuit can be closed on the unit circuit board by applying the connection element onto the contact area wherein the arrangement of the contacts in the contact area is dependent on the number of semiconductor light sources between at least one of a current infeed point or an end point of the luminous band and the contact area.

2. The lighting system as claimed in claim 1, wherein at least one electronic component is provided for closing the at least one circuit.

3. A lighting system comprising at least one connection element and at least one luminous band having at least one band-shaped unit circuit board, whereby the unit circuit board is equipped with at least two semiconductor light sources and has at least one contact area arranged between at least two semiconductor light sources, whereby the contact area is formed so it can be severed and the contact area and the connection element are configured such that after severing of the contact area the connection element can be applied onto the contact area and at least one circuit can be closed on the unit circuit board by applying the connection element onto the contact area, wherein, depending on the number of semiconductor light sources, different circuits are capable of being closed between at least one of a current infeed point or an end point of the luminous band and a contact area.

4. A lighting system comprising at least one connection element and at least one luminous band having at least one band-shaped unit circuit board, whereby the unit circuit board is equipped with at least two semiconductor light sources and has at least one contact area arranged between at least two semiconductor light sources, whereby the contact area is formed so it can be severed and the contact area and the connection element are configured such that after severing of the contact area the connection element can be applied onto the contact area and at least one circuit can be closed on the unit circuit board by applying the connection element onto the contact area, wherein at least one contact which transmits a potential which is approximately the same at a plurality of contact areas has the same position in the transverse direction at these contact areas.

5. The lighting system as claimed in claim 4, wherein as the number of semiconductor light sources between at least one of a current infeed point or an end point of the luminous band and the contact area increases, further contacts of the same contact area are distanced further from the at least one contact which is provided for transmitting a potential which is approximately the same at a plurality of contact areas.

6. The lighting system as claimed in claim 1, wherein at least one electronic component provided for closing the at least one circuit is inside a housing at least partially enclosing the connection element.

7. The lighting system as claimed in claim 1, wherein at least one electronic component provided for closing the at least one circuit is arranged spatially separate from the connection element.

8. The lighting system as claimed in claim 1, wherein at least one electronic component provided for closing the at least one circuit is arranged on a cooling device.

9. The lighting system as claimed in claim 1, wherein the connection element comprises at least one zero insertion force connection element.

10. The lighting system as claimed in claim 1, wherein at least two current-carrying elements, which can be subjected to a different potential during operation of the luminous band and are arranged in at least one contact area on opposite sides of the luminous band, are arranged transversally spaced from one another in the contact area.

11. The lighting system as claimed in claim 1, wherein the at least two semiconductor light sources are light-emitting diodes.

12. The lighting system as claimed in claim 1, wherein the at least one connection element comprises at least one of a plug or a clamp.

13. The lighting system as claimed in claim 2, wherein the at least one connection element comprises at least one of a resistor or a diode.

14. The lighting system as claimed in claim 8, wherein the cooling device comprises a heat sink.

15. The lighting system as claimed in claim 10, wherein the current-carrying elements comprise at least one of contacts or conductor paths.

16. The lighting system as claimed in claim 4, wherein at least one electronic component provided for closing the at least one circuit is inside a housing at least partially enclosing the connection element.

17. The lighting system as claimed in claim 4, wherein at least one electronic component provided for closing the at least one circuit is arranged spatially separate from the connection element.

18. The lighting system as claimed in claim 4, wherein at least one electronic component provided for closing the at least one circuit is arranged on a cooling device.

19. The lighting system as claimed in claim 4, wherein the at least two semiconductor light sources are light-emitting diodes.

20. The lighting system as claimed in claim 4, wherein the at least one connection element comprises at least one of a plug or a clamp.

* * * * *